US008741517B2

(12) United States Patent
Pang et al.

(10) Patent No.: US 8,741,517 B2
(45) **Date of Patent: *Jun. 3, 2014**

(54) TONER FOR DEVELOPING ELECTROSTATIC LATENT IMAGE AND METHOD OF PREPARING THE SAME

(75) Inventors: Kyeong Pang, Suwon-si (KR); Jun-young Lee, Seoul (KR); Tae-hoe Koo, Suwon-si (KR); Su-bum Park, Daegu (KR); Ju-yeon Lee, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 2 days.

This patent is subject to a terminal disclaimer.

(21) Appl. No.: 13/233,204

(22) Filed: Sep. 15, 2011

(65) Prior Publication Data

US 2012/0064450 A1 Mar. 15, 2012

(30) Foreign Application Priority Data

Sep. 15, 2010 (KR) ..... 10-2010-0090660

(51) Int. Cl.
*G03G 9/08* (2006.01)

(52) U.S. Cl.
USPC ..... 430/109.1; 430/108.1; 430/137.11; 430/110.2

(58) Field of Classification Search
USPC ..... 430/108.1–108.3, 110.2–110.4, 137.1
See application file for complete search history.

(56) References Cited

U.S. PATENT DOCUMENTS

| | | | | |
|---|---|---|---|---|
| 5,972,553 | A | 10/1999 | Katada et al. | |
| 2010/0159379 | A1* | 6/2010 | Lee et al. | 430/108.7 |
| 2012/0064450 | A1 | 3/2012 | Pang et al. | |
| 2012/0202149 | A1* | 8/2012 | Lee et al. | 430/108.5 |
| 2012/0214096 | A1* | 8/2012 | Pang et al. | 430/108.4 |

FOREIGN PATENT DOCUMENTS

| | | |
|---|---|---|
| JP | 2002-6553 | 1/2002 |
| KR | 10-0282314 | 12/1994 |
| KR | 10-2004-0105240 | 12/2004 |

OTHER PUBLICATIONS

Office Action dated Apr. 25, 2013 in co-pending U.S. Appl. No. 13/355,117.
Office Action dated Mar. 8, 2013 in co-pending U.S. Appl. No. 13/355,117.

* cited by examiner

*Primary Examiner* — Mark F Huff
*Assistant Examiner* — Rashid Alam
(74) *Attorney, Agent, or Firm* — Staas & Halsey LLP

(57) ABSTRACT

A toner includes a binder including two different weight molecular weight resins, a colorant, and a releasing agent, wherein a gel permeation chromatogram (GPC) molecular weight distribution curve of the toner has a major peak (Mp) present in a range of about $1.0\times10^4$ to about $3.0\times10^4$ g/mol and a shoulder curve starting at $1.0\times10^5$ g/mol or more, and a storage modulus (G') curve of the toner with respect to temperature has $T_s$, which is a temperature at which a storage modulus value begins to decrease, in a temperature range of about 50 to about 67° C.

9 Claims, 3 Drawing Sheets

TONER FOR DEVELOPING ELECTROSTATIC LATENT IMAGE AND METHOD OF PREPARING THE SAME

CROSS-REFERENCE TO RELATED APPLICATIONS

This application claims the benefit of Korean Patent Application No. 10-2010-0090660, filed on Sep. 15, 2010, in the Korean Intellectual Property Office, the disclosure of which is incorporated herein in its entirety by reference.

BACKGROUND

1. Field

The present disclosure relates to a toner for developing an electrostatic image and a method of preparing the toner.

2. Description of the Related Art

Electrophotographic techniques and electrostatic recording techniques use developers that visualize electrostatic images or electrostatic latent images. Developers can be categorized into two-component developers and one-component developers. Two-component developers include toner and carrier particles. One-component developers include just toner. One-component developers can be sub-categorized into magnetic one-component developers and non-magnetic one-component developers. In this regard, magnetic one-component developers contain a magnetic component and non-magnetic one-component developers do not contain a magnetic component. Non-magnetic one-component developers generally include a plasticizer to increase fluidity of toner. An example of the emulsifier is colloidal silica. In general, as toner, colored particles prepared by dispersing a colorant such as carbon black and additives in latex and forming the dispersion product into particles are used.

Toner can be prepared using a milling method or a polymerizing method. In the milling method, a synthetic resin, a colorant, and if necessary, additives are dissolved and mixed, the mixture is milled and the resultant particles are classified to obtain particles having a desired diameter. In the polymerizing method, a polymerizable monomer, a colorant, a polymerization initiator, and if necessary, additives, such as a crosslinking agent or an antistatic agent, are homogeneously dissolved or dispersed to form a polymerizable monomer composition; the polymerizable monomer composition is dispersed with an agitator in an aqueous dispersion medium containing a dispersion stabilizer so as to form droplet particles of the polymerizable monomer composition; and then the temperature is increased and a suspension-polymerization process is performed thereon to obtain color polymerization particles having desired particle diameters, that is, polymerization toner.

Typically, for use in an image forming apparatus, toner obtained by using the milling method is often used. However, when toner is prepared by using the milling method, the particle size, geometric size distribution, and structure of the toner may not be accurately controlled, and thus, it is difficult to independently control major characteristics required to the toner, such as a electrifying characteristic, a fusing characteristic, a flowing characteristic, or a preservation characteristic.

Recently, a polymerization toner of which a particle size is easily controllable, and which does not require a complicated manufacturing process, such as a classification process, is getting attention. If a toner is prepared by polymerization, a polymerization toner having a desired particle size and a geometric size distribution may be obtainable without a milling process or a classification process. From among various polymerization methods, a toner agglomeration method using a metallic salt, such as $MgCl_2$ or NaCl, or a polymer-type poly aluminum chloride (PAC) is proposed to uniformly control a particle size and a particle shape.

An agglomerating agent based on such metallic salts, with a certain level of reproducibility, enables the toner particle size or geometric size distribution to be controlled and enables a capsule structure to be constructed based on the introduction of a shell. Thus, toner having such features is used in practice. However, there is still a problem in uniformly controlling the particle size and shape. That is, when the particle size is equal to or greater than the center of the toner geometric size distribution, the toner size and shape are efficiently controlled. However, when the toner particle size is within a relatively small particle size range in the geometric size distribution, the toner particle has a higher circularity than a desired shape. Thus, in an electrostatic latent image process, blade cleaning may occur improperly.

Also, to obtain high gloss and wide fusing latitude of toner simultaneously, the toner structure is controlled to have a capsule shape through the agglomeration process. By doing so, surface exposure of a pigment and a releasing agent is suppressed, thereby contributing to uniform electrification, flowability, and thermal preservation characteristics. An offset-resistant property of toner is a critical factor in securing a stable fusing latitude, and is closely related to a rheology property of toner. The rheology property is dependent upon, for example, a molecular weight or a crosslinking level of a resin, or a releasing agent.

SUMMARY

Additional aspects and/or advantages will be set forth in part in the description which follows and, in part, will be apparent from the description, or may be learned by practice of the invention.

According to an aspect of the present disclosure, there is provided a toner for developing an electrostatic latent image, wherein the toner includes: a binder including at least two resins which have a different weight-average molecular weight from each other, a colorant, and a releasing agent, wherein a gel permeation chromatogram (GPC) molecular weight distribution curve of the toner has a major peak (Mp) present in a range of about $1.0\times10^4$ to about $3.0\times10^4$ g/mol and a shoulder curve starting at about $1.0\times10^5$ g/mol or more, and a storage modulus (G') curve of the toner with respect to temperature has Ts, which is a temperature at which a storage modulus value begins to decrease, in a temperature range of about 50 to about 67° C.

In the GPC molecular weight distribution of the toner, an amount of a fraction of $5\times10^6$ g/mol or more in the toner may be in a range of about 0.1 to about 1.0 wt %, an amount of a fraction of $1\times10^6$ g/mol or more and less than $5\times10^6$ g/mol in the toner may be in a range of about 0.5 to about 3.0 wt %, an amount of a fraction of $1\times10^5$ g/mol or more and less than $5\times10^5$ g/mol in the toner may be in a range of about 3.0 to about 10 wt %, and an amount of a fraction of less than $2\times10^4$ g/mol in the toner may be in a range of about 45 to about 70 wt %.

The toner may have a weight average molecular weight of about $3.0\times10^4$ to about $5.0\times10^5$ g/mol and a Z average molecular weight of about $1.0\times10^6$ to about $5.0\times10^7$ g/mol.

In the storage modulus (G') curve of the toner with respect to temperature, S1 (=[Log G'(80)−Log G'(100)]/20) may be in a range of about 0.03 to about 0.1, S2 (=[Log G'(110)−Log G'(160)]/50) may be in a range of about 0.01 to about 0.05, S1/S2 may be in a range of about 1.4 to about 5.0, and G'(160)

may be in a range of about $1.0\times10^2$ to about $3.0\times10^3$, wherein G'(80), G'(100), G'(110) and G'(160) respectively denote storage moduli (Pa) at temperatures of 80° C., 100° C., 110° C. and 160° C. at an angular speed of 6.28 rad/second, a temperature increase rate of 2.0° C./minute, and an initial deformation rate of 0.3%.

The toner may include Fe of about $1.0\times10^3$ to about $1.0\times10^4$ ppm and Si of about $1.0\times10^3$ to about $5.0\times10^3$ ppm.

A ratio of [S]/[Fe] may be in a range of about $5.0\times10^{-4}$ to about $5.0\times10^{-2}$, wherein [Fe] is an intensity of an iron in the toner evaluated by fluorescent X-ray measurement and [S] is an intensity of a sulfur in the toner evaluated by fluorescent X-ray measurement.

An average particle size of the toner may be in a range of about 3 to about 9 μm. An average circularity of the toner is in a range of about 0.940 to about 0.990.

A GSDv value and a GSDp value of the toner are each about 1.30 or less.

According to an aspect of the present disclosure, there is provided a method of preparing a toner for developing an electrostatic latent image, wherein the method includes: preparing a mixed solution by mixing a primary binder particle including two different weight average molecular weight resin latexes, a colorant dispersion, and a releasing agent dispersion; forming a core layer forming particle by adding an agglomerating agent to the mixed solution; and preparing a toner particle by covering the core layer forming particle with a shell layer forming particle including a secondary binder particle prepared by polymerizing one or more polymerizable monomers, wherein the toner particle is the toner of the present disclosure.

The two different weight average molecular weight resin latexes may include a low molecular weight resin latex having a weight average molecular weight of about $1.3\times10^4$ to about $3.0\times10^4$ g/mol and a high molecular weight resin latex having a weight average molecular weight of about $1.0\times10^5$ to about $5.0\times10^6$ g/mol.

A weight ratio of the low molecular weight resin latex to the high molecular weight resin latex may be in a range of 99:1 to 70:30.

The preparing of the toner particle may include: a) agglomerating the core layer forming particle and the shell layer forming particle in a temperature range in which a shear storage modulus (G') of each of the core layer forming particle and shell layer forming particle is in a range of about $1.0\times10^8$ to about $1.0\times10^9$ Pa; b) stopping the agglomeration reaction when an average particle size of particles formed in the a) process is about 70 to about 100% of the toner particle; and c) fusing-coalescing particles obtained in the b) process in a temperature range in which the shear storage modulus (G') of the particles obtained in the b) process is in a range of about $1.0\times10^4$ to about $1.0\times10^9$ Pa.

A tertiary binder particle further may cover the toner particle.

The releasing agent dispersion may include a paraffin-based wax and an ester-based wax.

An amount of the ester-based wax may be in a range of about 1 to about 35 wt % based on the total weight of the paraffin-based wax and the ester-based wax.

The agglomerating agent may include a Si and Fe-containing metallic salt.

The agglomerating agent may include a polysilicate iron.

The agglomerating agent solution may have a pH of about 2.0 or less.

BRIEF DESCRIPTION OF THE DRAWINGS

The above and other features and advantages of the present disclosure will become more apparent by describing in detail exemplary embodiments thereof with reference to the attached drawings in which.

DETAILED DESCRIPTION

Figure 1:
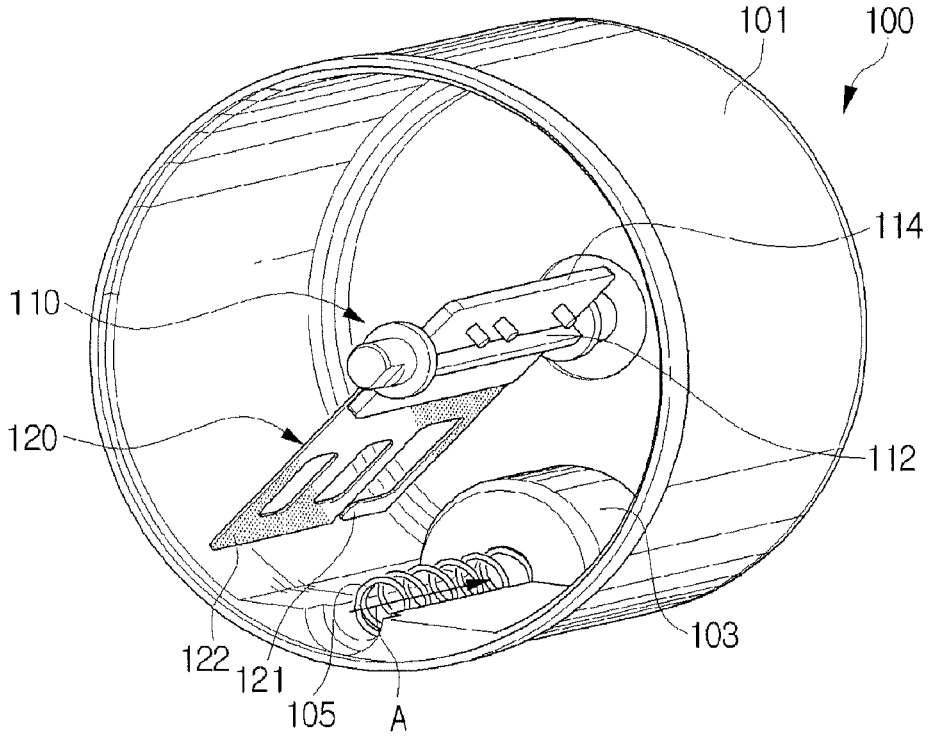
FIG. 1 is a view of a supplying unit for a toner according to an embodiment of the present disclosure.

Reference will now be made in detail to the embodiments, examples of which are illustrated in the accompanying drawings, wherein like reference numerals refer to the like elements throughout. The embodiments are described below to explain the present invention by referring to the figures.

Hereinafter, the present disclosure will be described in detail.

Toner for developing an electrostatic latent image according to the present disclosure includes a binder including at least two resins which have a different weight-average molecular weight from each other, a colorant, and a releasing agent, wherein a gel permeation chromatogram (GPC) molecular weight distribution curve of the toner has a major peak (Mp) present in a range of about $1.0\times10^4$ to about $3.0\times10^4$ g/mol and a shoulder curve starting at about $1.0\times10^5$ g/mol or more, and a storage modulus (G') curve of the toner with respect to temperature has Ts, which is a temperature at which a storage modulus value begins to decrease, in a temperature range of about 50 to about 67° C.

A toner molecular weight affects a gloss property and a fusing property of the toner. A toner molecular weight distribution may be obtained from a GPC of the toner. In this case, a molecular weight distribution of a binder formed of a polymer resin almost corresponds to the toner molecular weight distribution.

Accordingly, if only one binder resin is used, the toner molecular weight distribution curve is one normal distribution curve. However, if two different binder resins including a low molecular weight binder resin and a high molecular weight binder resin are used, the toner molecular weight distribution curve consists of a major distribution curve corresponding to a molecular weight distribution of the low molecular weight resin and a shoulder curve having a gentle slope and low height corresponding to a molecular weight distribution of the high molecular weight resin. If the high molecular weight resin content is too high, a double peak is formed, and in this case, an offset-resistant property is good, but it is difficult to obtain high gloss.

As such, if a toner is prepared using a binder including two different molecular weight resins at an appropriate ratio, the respective resins independently perform their functions. That is, the rheological property of the toner may be controlled in such a way that the low molecular weight resin with a critical molecular weight or less has no entanglement in a molecular chain thereof and thus, shows a function in terms of a minimum fusing temperature (MFT) and gloss, on the other hand, the high molecular weight resin has entanglement in a molecular chain thereof and thus, enables the formed toner to maintain a certain level of elasticity even at high temperature, thereby contributing to an offset-resistant property.

Accordingly, in the toner molecular weight distribution curve, a summit of a major curve, that is, the major peak may be present in, for example, a range of about $8\times10^3$ to about $4.0\times10^4$ g/mol, a range of about $1.0\times10^4$ to about $3.0\times10^4$ g/mol, or a range of about $1.3\times10^4$ to about $2.5\times10^4$ g/mol. If the location of the major peak is in the ranges described above, melt viscosity of the toner is improved and thus, gloss and a fusing property improve.

In the toner molecular weight distribution curve having a major distribution curve and a shoulder curve, a point at which as the molecular weight increases, the downward slope of the major distribution curve finishes and the upward gentle slope starts, is referred to as a shoulder starting point. For example, please refer to an inflexion point indicated by an arrow in the molecular weight distribution curve shown in FIG. 3.

Figure 3:
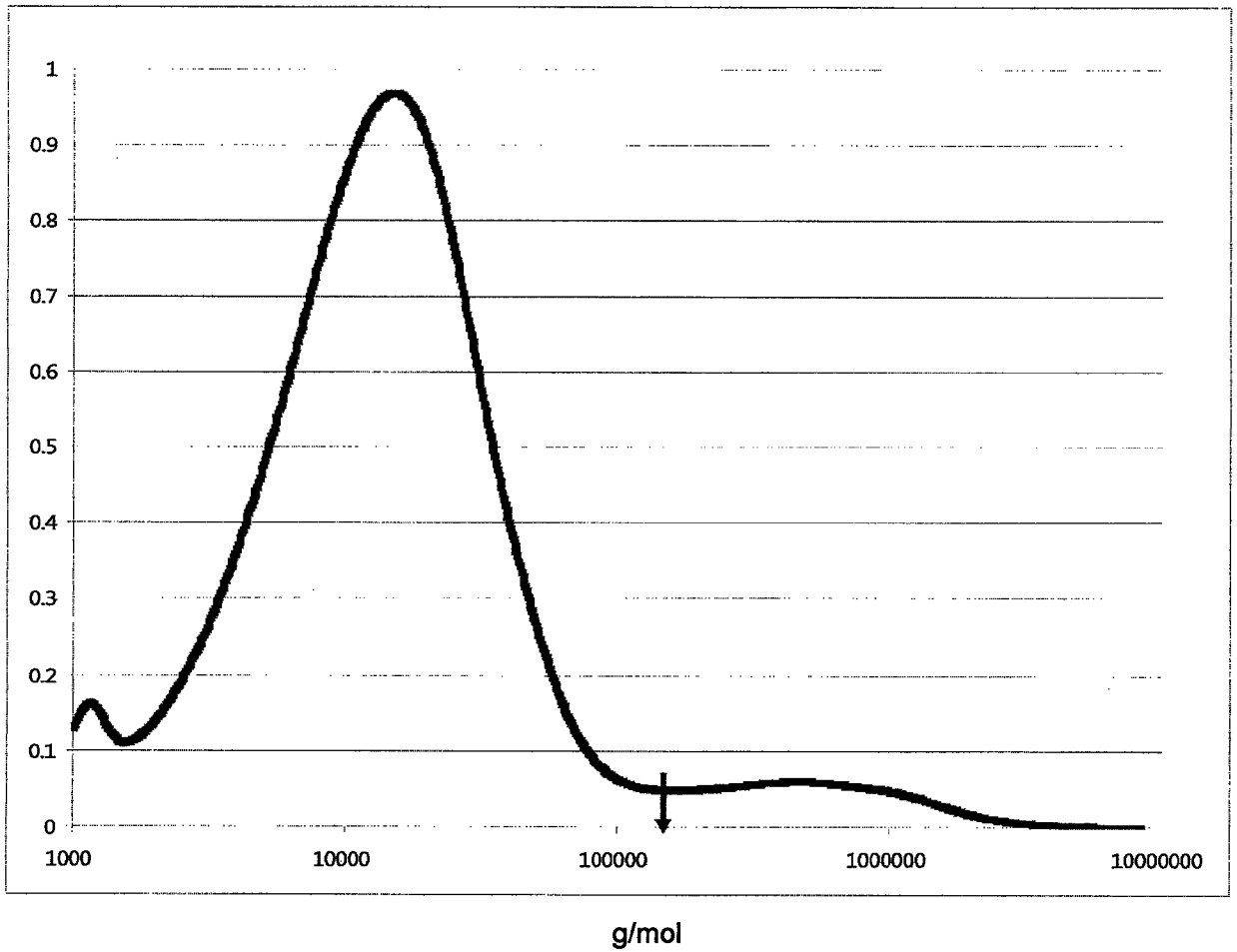
FIG. 3 is a graph showing a molecular weight distribution curve according to an embodiment of the present disclosure.

Referring to FIG. 3, the shoulder starting point may be present at about $1.0\times10^5$ g/mol or more, for example, in a range of about $1.5\times10^5$ to about $5.0\times10^6$ g/mol or a range of about $2.0\times10^5$ to about $4.5\times10^6$ g/mol.

If the shoulder starting point is within the ranges described above, an offset-resistant property of toner at high temperature improves and a wide fusing latitude is secured and durability and gloss may be improved. However, if the shoulder starting point is outside the ranges described above, even when two different binder resins including a low molecular weight resin and a high molecular weight resin are used, an offset-resistant property, durability, and gloss may not be obtained simultaneously.

In a storage modulus (G') curve obtained by measuring visco-elasticity of toner with respect to temperature, a slope temperature (Ts), a temperature at which a storage modulus value begins to decrease, is present in a range of about 50 to about 67° C. For example, Ts may be present in a range of about 53 to about 61° C.

The temperature at which a storage modulus value of toner begins to decrease refers to a temperature at which thermal deformation of toner begins as temperature increases when visco-elasticity is measured. When the formed toner is housed in an image forming apparatus, such as a printer, and used in practice, typically, toner is exposed to heat that is generated under driving conditions including a high speed driving and fusing in the image forming apparatus, and as a result, it is highly likely that the temperature of the image forming apparatus increases up to about 50° C. Accordingly, if Ts of toner is about 50° C. or more, blocking between toner particles due to thermal deformation at the toner surface under driving conditions of the image forming apparatus may be preventable. Also, if Ts of toner is about 67° C. or lower, low-temperature a fusing property may be improved. If Ts is present in a range of about 53 to about 61° C., the anti-blocking property and the cold fusing property may be further improved.

As such, if in the GPC molecular weight distribution curve of toner, the major peak (Mp) is present in a range of about $1.0\times10^4$ to about $3.0\times10^4$ g/mol, the shoulder curve beings at about $1.0\times10^5$ g/mol or more, and in the storage modulus (G') curve of toner with respect to temperature, Ts, at which the storage modulus value begins to decrease, is present in a range of about 50 to about 67° C., toner performance properties, such as gloss, a fusing property, offset-resistant property, durability, or prevention of blocking, may be satisfied simultaneously.

According to an embodiment of the present disclosure, in the GPC molecular weight distribution of the toner, an amount of a fraction of $5\times10^6$ g/mol or more in the toner is in a range of about 0.1 to about 1.0 weight (wt) %, an amount of a fraction of $1\times10^6$ g/mol or more and less than $5\times10^6$ g/mol in the toner is in a range of about 0.5 to about 3.0 wt %, an amount of a fraction of $1\times10^5$ g/mol or more and less than $5\times10^5$ g/mol in the toner is in a range of about 3.0 to about 10 wt %, and an amount of a fraction of less than $2\times10^4$ g/mol in the toner is in a range of about 45 to about 70 wt %. Also, the remaining amount of the toner may be occupied with amounts of other fractions. If the toner satisfies the conditions described above, the major peak (Mp) present in the range of about $1.0\times10^4$ to about $3.0\times10^4$ g/mol, and the shoulder curve starting at about $1.0\times10^5$ g/mol or more may be easily accomplished.

According to another embodiment of the present disclosure, the toner may have a weight average molecular weight of about $3.0\times10^4$ to about $5.0\times10^5$ g/mol and about a Z average molecular weight of $1.0\times10^6$ to about $5.0\times10^7$ g/mol.

That is, when the toner weight average molecular weight is about $3.0\times10^4$ or more, durability of toner increases and toner blocking may be prevented during high-temperature preservation. Also, when the toner weight average molecular weight is about $5.0\times10^5$ g/mol or lower, excellent a fusing property of toner may be maintained.

Also, the Z average molecular weight of toner is a main indicator for a polymer distribution in the toner molecular weight distribution, and the polymer distribution is a critical element in determining toughness of molten toner during exfoliation. Accordingly, when the Z average molecular weight of toner is in the range of about $1.0\times10^6$ to about $5.0\times10^7$ g/mol, the toner has improved offset-resistant property and gloss.

In the storage modulus (G') curve of toner with respect to temperature that is used to evaluate visco-elasticity, a value of [Log G'(80)−Log G'(100)]/20 (slope 1, S1) may be in a range of about 0.03 to about 0.1, a value of [Log G'(110)−Log G'(160)]/50 (slope 2, S2) may be in a range of about 0.01 to about 0.05, a value of G'(160) may be in a range of about $1.0\times10^2$ to about $3.0\times10^3$, and S1/S2 which is a ratio of the slope 1 to the slope 2, may be in a range of about 1.4 to about 5.

In this case, G'(80), G'(100), G'(110), and G'(160) respectively indicate storage moduli (Pa) at temperatures of 80° C., 100° C., 110° C., and 160° C., which are obtained by measuring dynamic visco-elasticity of toner using a two circular disc-shape rheometer (for example, TA INSTROMENTS ARES rheometer) under conditions including use of a sample disc having a diameter of 8 mm and a height of 1.5 to 2.5 mm, an angular speed of 6.28 rad/second, a temperature increase rate of 1.0° C./minute, and an initial deformation rate of 0.3% (the deformation rate is automatically controlled during measurement).

The toner visco-elasticity may be affected by various causes, such as thermal properties of toner (Tg etc.), a crosslinking level, dispersibility, compatibility, distribution, or used materials. In particular, G'(60) and G'(80), that is, visco-elasticity at a temperature of 100° C. or lower, are dependent upon Tg or Tm of a binder and a releasing agent, an agglomerating agent, a colorant, etc. Also, G'(110) and G'(160), that is, visco-elasticity at a temperature of 100° C. or higher, are dependent upon inner-dispersibility, a molecular weight, a crosslinking level, and a particle size distribution of the toner, rather than thermal properties of a binder or a releasing agent. Accordingly, G'(60), G'(80), G'(110), and G'(160) may be determined by characteristics of raw materials such as a binder, a colorant, a releasing agent, an agglomerating agent, or the like used in preparing a toner, and physical characteristics of the formed toner.

Also, from G'(80), G'(100), G'(110) and G'(160), fusing related characteristics of the toner, such as a cold offset, a minimum fusing temperature (MFT), or a fusing latitude, may be expected.

Also, if the value of [Log G'(80)−Log G'(100)]/20 of toner is, for example, in a range of about 0.03 to about 0.1 or a range of about 0.04 to 0.07 and a value of [Log G'(60)−Log G'(80)]/20 is within the range described above, the slope of an elastic modulus of toner at around melting point of latex rapidly descends, and thus, the toner is sufficiently molten during fusing, thereby enabling low temperature fusing with a relatively low heat amount in a relatively short period of time during fusing. Thus, a stable image may be easily obtainable and a low temperature high-speed fusing is achievable.

Also, the value of [Log G'(110)−Log G'(160)]/50 of toner may be, for example, in a range of about 0.01 to about 0.05 or about 0.02 to about 0.04. If the value of [Log G'(110)−Log G'(160)]/50 is within the range described above, in a temperature range of about 110 to about 160° C., that is, in a temperature transition range from a low temperature to a high temperature, the storage modulus slope maintains gently and thus, an offset at high temperature during fusing of toner is prevented, and thus gloss staining does not occur. Thus, high image quality, high gloss, and excellent color reproduction may be obtained.

The value of G'(160) of toner may be in a range of, for example, about $1.0\times10^2$ to about $3.0\times10^3$, about $1.5\times10^2$ to about $1.5\times10^3$, or about $6.0\times10^2$ to about $1.0\times10^3$. In this case, the value of G'(160) affects the hot offset property and gloss. If the value of G'(160) is within the ranges described above, toner that is heated and softened during fusing has sufficient rubber elasticity, and thus the toner may be easily separated from a fusing member, a hot offset on the fusing member is prevented, and due to sufficient rubber elasticity of toner, toner may be appropriately adsorbed to a paper sheet, thereby having an improved gloss. That is, if viscosity is too low and thus elasticity is too low, molten toner may permeate into the paper sheet and the paper grain may appear, thereby decreasing a smoothness level of an image and gloss of the image. Accordingly, there is a need to have an appropriate range of elasticity and viscosity values, that is, appropriate visco-elasticity characteristics.

Regarding the toner, [Si]/[Fe] may be in a range of about $5.0\times10^{-4}$ to about $5.0\times10^{-2}$ and [S]/[Fe] may be in a range of about $5.0\times10^{-4}$ to about $5.0\times10^{-2}$, wherein [Fe] indicates an iron intensity evaluated by fluorescent X-ray measurement, [Si] indicates a silicon intensity evaluated by fluorescent X-ray measurement, and [S] indicates a sulfur intensity evaluated by fluorescent X-ray measurement.

The iron intensity [Fe] corresponds to an amount of iron included in an agglomerating agent that is used to agglomerate a latex, a colorant and a releasing agent when toner is prepared. Accordingly, the iron intensity [Fe] may affect the agglomeration property, particle size distribution, and particle size of an agglomerated toner that constitutes a precursor for preparing a final toner.

The silicon intensity [Si] corresponds to an amount of silicon included in an agglomerating agent used in preparing toner or an amount of silicon included in silica particles that are externally added to secure flowability of toner. Accordingly, the silicon intensity [Si] may affect such properties as described above with the iron and flowability of the toner.

A ratio of the silicon intensity [Si] to the iron intensity [Fe], [Si]/[Fe], may be in a range of, for example, about $5.0\times10^{-4}$ to about $5.0\times10^{-2}$, about $8.0\times10^{-4}$ to about $3.0\times10^{-2}$, or about $1.0\times10^{-3}$ to about $1.0\times10^{-2}$.

If the ratio of [Si]/[Fe] is in the range of about $5.0\times10^{-4}$ to about $5.0\times10^{-2}$, an amount of an external additive silica is appropriately controlled, and thus flowability of toner is improved and the interior of a printer housing the toner may not be contaminated.

The sulfur intensity [S] corresponds to an amount of sulfur included in a chain transfer agent, that is, a sulfur-containing compound, that is used to control a molecular weight distribution of a latex for toner. Accordingly, if the sulfur intensity [S] is high, the latex molecular weight may reduce and a new chain may be initiated, and if the sulfur intensity [S] is low, the chain may continuously increase and the latex molecular weight may increase.

In this case, if the ratio of [S]/[Fe] is in the range of about $5.0\times10^{-4}$ to about $5.0\times10^{-2}$, an agglomeration property and an electrification property may be improved, and thus a toner having an appropriate molecular weight, particle size distribution, and particle size may be formed.

As described above, the toner includes Fe and Si. The amount of Fe may be in a range of, for example, about $1.0\times10^3$ to about $1.0\times10^4$ ppm, about $2.0\times10^3$ to about $0.8\times10^4$ ppm, or about $4.0\times10^3$ to about $0.6\times10^4$ ppm. Also, the amount of Si may be in a range of, for example, about $1.0\times10^3$ to about $5.0\times10^3$ ppm, about $1.5\times10^3$ to about $4.5\times10^3$ ppm, or about $2.0\times10^3$ to about $4.0\times10^3$ ppm.

In this case, if the amounts of Fe and Si are within the ranges described above, an electrification property of the toner may be improved and the interior of a printer housing the toner may not be contaminated.

A volume average particle size of the toner according to an embodiment of the present disclosure may be in a range of, for example, about 3.0 to about 9.0 μm, about 4.0 to about 8.7 μm, or about 5.0 to about 8.5 μm, and an average of circularity may be in a range of, for example, about 0.940 to about 0.990, about 0.945 to about 0.985, or 0.950 to 0.980.

In general, smaller toner particles are advantageous to high resolution and high image quality. However, they are disadvantageous in terms of a transfer speed and a washing property. Accordingly, it is important to have an appropriate particle size.

The volume average particle diameter of the toner may be measured by electrical impedance analysis.

If the volume average particle diameter of the toner is about 3.0 μm or more, a photo conductor may be cleaned well, the production yield may be increased when mass-produced, scattering-induced harmful effect on the human body may be prevented, and high resolution and high image quality can be obtained. If the volume average particle diameter of the toner is about 9.0 μm or lower, electrification may be uniformly performed, a fusing property of toner may be improved, it is easy for a Dr-blade to control a toner layer.

Circularity of toner may be measured by using FPIA-3000 equipment produced by SYSMEX Co., Inc. using the equation as follows:

$$\text{Circularity}=2\times(\pi\times\text{area})^{0.5}/\text{circumference}. \qquad \text{<Equation>}$$

The circularity may be in the range of 0 to 1, and as the circularity approaches 1, the toner particle shape becomes more circular.

If the average circularity of the toner is 0.940 or more, a thickness of an image formed on a transfer medium is appropriate and thus, toner consumption may be reduced. Also, an opening between toner particles may not be too large and thus the image formed on the transfer medium may have a sufficient coverage rate. If the average circularity of the toner is 0.990 or lower, excessive toner supply onto a development sleeve is prevented and thus contamination of the development sleeve due to non-uniform toner coverage thereon may be prevented.

As an indicator for a toner particle-size distribution, a volume average particle-size distribution GSDv or a number average particle-size distribution GSDp may be used, and the GSDv and the GSDp may be measured in the following manner.

First, a toner particle diameter distribution is obtained using toner particle diameters measured using a Multisizer III (manufactured by BECKMAN COULTER INC.). The toner particle diameter distribution is divided at predetermined particle diameter ranges (channels). With respect to the respective divided particle diameter ranges (channels), the cumulative volume distribution of toner particles and the cumulative number distribution of toner particles are measured, wherein, in each of the cumulative volume and number distributions, the particle size in each distribution is increased in a direction from small diameter to large diameter. A particle diameter at 16% of the respective cumulative distributions is defined as a volume average particle diameter D16v and a number average particle diameter D16p, respectively. Likewise, a particle diameter at 50% of the respective cumulative distributions is defined as a volume average particle diameter D50v and a number average particle diameter D50p, respectively. Likewise, a particle diameter at 84% of the respective cumulative distributions is defined as a volume average particle diameter D84v and a number average particle diameter D84p.

In this case, GSDv is defined as $(D84v/D16v)^{0.5}$, and GSDp is defined as $(D84p/D16p)^{0.5}$.

In this regard, the GSDv and GSDp are each, for example, about 1.30 or less, in the range of about 1.15 to about 1.30, or in the range of about 1.20 to about 1.25. If the GSDv and GSDp are within the ranges described above, uniform toner particle size may be obtained.

A method of preparing the toner for developing an electrostatic latent image according to an embodiment of the present disclosure includes mixing a primary binder particle including two different weight average molecular weight resin latex, a colorant dispersion, and a releasing agent dispersion to prepare a mixed solution; adding an agglomerating agent solution to the mixed solution to prepare a core layer forming particle; and covering the core layer forming particle with a shell layer forming particle including a secondary binder particle prepared by polymerizing one or more polymerizable monomers, wherein the toner includes a binder including two different weight average molecular weight resins, a colorant, and a releasing agent, a GPC distribution curve of the toner has a major peak (Mp) present in a range of about $1.3\times10^3$ to about $2.5\times10^3$ g/mol and a shoulder starting point at about $1.0\times10^5$ g/mol or more, and a storage modulus (G') curve of the toner with respect to temperature has $T_s$, which is a temperature at which a storage modulus value begins to decrease, in a temperature range of about 50 to about 65° C.

Regarding the method, the primary binder particle may be a polymer prepared by polymerizing one or more polymerizable monomers, polyester alone, or a mixture thereof (hybrid type). When the polymer is used, the polymerizable monomers may be polymerized together with a releasing agent such as wax. Alternatively, a releasing agent may be separately mixed with the polymer.

The primary binder particle includes two different weight average molecular weight resin latex, that is, a low molecular weight resin latex and a high molecular weight resin latex.

The high molecular weight resin latex has a weight average molecular weight of, for example, about $1.0\times10^5$ to about $5.0\times10^6$ g/mol, about $1.5\times10^5$ to about $3.5\times10^6$ g/mol, or about $2.0\times10^5$ to about $3.0\times10^6$ g/mol. If the weight average molecular weight of the high molecular weight resin latex is within the ranges described above, a wide fusing latitude may be secured, and durability and gloss may be improved.

A weight ratio of the low molecular weight resin latex to the high molecular weight resin latex may be, for example, 99:1 to 70:30, 97:3 to 80:20, or 95:5 to 85:15.

If the weight ratio is in the range of 99:1 to 70:30, durability and hot offset property of the toner may be improved, high glossy toner may be obtained.

That is, in preparing the primary binder particle, the low molecular weight resin latex having a critical molecular weight or less is prepared to have a volume average particle size of about 100 to 300 nm, and the high molecular weight resin latex having a high molecular weight is emulsion-polymerized or dispersed to have a volume average particle size of about 100 to about 300 nm.

If the volume average particle sizes of the low molecular weight resin latex and the high molecular weight resin latex are in the range of about 100 to about 300 nm, the agglomeration level may be easily controlled during the toner preparation, thereby enabling formation of a final toner having a desired particle size.

The low molecular weight resin latex may have a weight average molecular weight of, for example, about $1.3\times10^4$ to about $3.0\times10^4$ g/mol, about $1.5\times10^4$ to about $2.8\times10^4$ g/mol, or about $1.7\times10^4$ to about $2.5\times10^4$ g/mol. If the low molecular weight resin latex is within the molecular weight ranges described above, toner strength may be improved and durability and a fusing property of the toner may be improved.

The polymerizable monomer used herein may include at least one selected from the group consisting of styrene-based monomers such as styrene, vinyltoluene, or α-methylstyrene; acrylic acids, methacrylic acids; derivatives of (meth)acrylic acid such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonirile, methacrylonirile, acrylamide, or methacrylamide; ethylenically unsaturated mono-olefines such as ethylene, propylene, or butylene; halogenated vinyls such as vinyl chloride, vinylidene chloride, or vinyl fluoride; vinyl esters such as vinyl acetate or vinyl propionate; vinylethers such as vinylmethylether or vinylethylether; vinylketones such as vinylmethylketone or methylisoprophenylketone; nitrogen-containing vinyl compounds such as 2-vinylpyridine, 4-vinylpyridine and N-vinylpyrrolidone.

When the primary binder particle is manufactured, a polymerization initiator and a chain transfer agent may be further used to efficiently perform the polymerization process.

Examples of the polymerization initiator include persulfates such as potassium persulfate or ammonium persulfate; azo compounds such as 4,4-azobis(4-cyano valeric acid), dimethyl-2,2'-azobis(2-methylpropionate), 2,2-azobis(2-amidinopropane)dihydrochloride, 2,2-azobis-2-methyl-N-1, 1-bis(hydroxymethyl)-2-hydroxyethylpropioamide, 2,2'-azobis(2,4-dimethylvaleronirile), 2,2'-azobisisobutyronirile, or 1,1'-azobis(1-cyclohexancarbonirile); and peroxides such as methylethylperoxide, di-t-butylperoxide, acetylperoxide, dikumylperoxide, lauroylperoxide, benzoylperoxide, t-butylperoxy-2-ethylhexanoate, di-isopropylperoxydicarbonate, or di-t-butylperoxyisophthalate. In addition, oxidation-reduction initiators prepared by combining these polymerization initiators and reductants may also be used as the polymerization initiator.

The chain transfer agent refers to a material that changes the type of a chain carrier when a chain reaction occurs. The chain transfer agent includes a material that induces new chain activity to be substantially weaker than the existing chain activity. Due to the chain transfer agent, a polymerization degree of polymerizable monomers can be reduced and a novel chain can be initiated. Due to the chain transfer agent, molecular weight distributions can be controlled.

The amount of the chain transfer agent may be, for example, in the range of about 0.1 to about 5 parts by weight, about 0.2 to about 3 parts by weight, or about 0.5 to about 2.0 parts by weight, based on 100 parts by weight of the one or more polymerizable monomers. If the amount of the chain transfer agent is within the range described above, the molecular weight of a polymer is appropriately controlled and agglomeration efficiency and fusing performance may be increased.

Examples of the chain transfer agent include sulfur-containing compounds such as dodecanethiol, thioglycolic acid, thioacetic acid, or mercaptoethanol; phosphorous acid compounds such as a phosphorous acid or sodium phosphite; hypophosphorous acid compounds such as a hypophosphorous acid or a sodium hypophosphite; and alcohols such as methylalcohol, ethylalcohol, isopropylalcohol, or n-butylalcohol. However, the chain transfer agent is not limited to those materials.

The primary binder particle may further include an electrification control agent. The electrification control agent used in embodiments of the present disclosure may be a negatively charged electrification control agent or a positively charged electrification control agent. Examples of the negatively charged electrification control agent include an organic metal complex or chelate compounds such as a chrominum-containing azo dyes or a monoazo metal complex; metal-containing salicylic acid compounds wherein the metal may be chrominum, iron, or zinc; and organic metal complexes derived from aromatic hydroxycarboxylic acids or aromatic dicarboxylic acids. However, the negatively charged electrification controller may not be particularly limited as long as it is publicly known. Examples of the positively charged electrification controller include a modified product derived from nigrosine and a fatty acid metal salt thereof and an onium salt including a quaternary ammonium salt such as tributylbenzylammonium 1-hydroxy-4-naphthosulfonate and tetrabutylammonium tetrafluoro borate. These electrification controllers may be used alone or in combination. The electrification controller stably supports toner on a development roller with an electrostatic force. Thus, by using the electrification controller, stable and high electrifying speeds can be obtained.

The primary binder particle obtained as described above may be mixed with the colorant dispersion and the releasing agent dispersion to prepare a mixed solution. The colorant dispersion may be obtained by uniformly dispersing a composition including a colorant, such as a black colorant, a cyan colorant, a magenta colorant, or a yellow colorant, and an emulsifier by using an ultrasonic homogenizer or a micro fluidizer.

Among colorants used to prepare the colorant dispersion, the black colorant may be a carbon black or aniline black. For color colorant, at least one colorant selected from the group consisting of the cyan colorant, the magenta colorant, and the yellow colorant may be used .

The yellow colorant may be a condensed nitrogen compound, an isoindolinone compound, an anthraquine compound, an azo metal complex, or an alyl imide compound. Examples of the yellow colorant include C.I. pigment yellows 12, 13, 14, 17, 62, 74, 83, 93, 94, 95, 109, 110, 111, 128, 129, 147, 168, and 180.

Examples of the magenta colorant include condensed nitrogen compounds, anthraquine compounds, quinacridone compounds, base dye rate compounds, naphthol compounds, benzo imidazole compounds, thioindigo compounds, and perylene compounds. Specifically, examples of the magenta colorant include C.I. pigment reds 2, 3, 5, 6, 7, 23, 48:2, 48:3, 48:4, 57:1, 81:1, 122, 144, 146, 166, 169, 177, 184, 185, 202, 206, 220, 221, and 254.

Examples of the cyan colorant include copper phthalocyanie compounds and derivatives thereof, anthraquine compounds, and base dye rate compounds. Specifically, examples of the cyan colorant include C.I. pigment blues 1, 7, 15, 15:1, 15:2, 15:3, 15:4, 60, 62, and 66.

These colorants may be used alone or in combination, and may be selected in consideration of color, chroma, brightness, weather resistance, or dispersibility in toner.

The amount of the colorant used to prepare the colorant dispersion may not be particularly limited as long as the toner is sufficiently colored. For example, the amount of the colorant may be in the range of about 0.5 to about 15 parts by weight, about 1 to about 12 parts by weight, or about 2 to about 10 parts by weight, based on 100 parts by weight of the toner. If the amount of the colorant used to prepare the colorant dispersion is within the range described above, a coloring effect may be obtained and sufficient triboelectric charging quantity may be obtained.

The emulsifier used to prepare the colorant dispersion may be any emulsifier that is known in the art. For example, the emulsifier may be an anionic reactive emulsifier, a non-ionic reactive emulsifier, or a mixture thereof. The anionic reactive emulsifier may be HS-10 (manufactured by DAI-ICHI KOGYO INC.) or Dawfax 2-A1 (manufactured by RHODIA INC.). The non-ionic reactive emulsifier may be RN-10 (manufactured by DAI-ICHI KOGYO INC.).

The releasing agent dispersion used in the method of preparing toner may include a releasing agent, water, an emulsifier, etc.

The releasing agent enables toner to be fused to a final image receptor at a low fusing temperature and to have excellent final image durability and abrasion-resistance characteristics. Thus, characteristics of toner are very dependent upon the type and amount of the releasing agent.

An available releasing agent may be, but is not limited to, polyethylene-based wax, polypropylene-based wax, silicon wax, paraffin-based wax, ester-based wax, carnauba wax, or metallocene wax. The melting point of the releasing agent may be, for example, in the range of about 50 to about 150° C. The releasing agent may be physically attached to toner particles, but does not covalently bind to toner particles.

The amount of the releasing agent may be in the range of about 1 to about 20 parts by weight, about 2 to about 16 parts by weight, or about 3 to about 12 parts by weight, based on 100 parts by weight of the toner. If the amount of the releasing agent is within this range, low-temperature fusing performance may be improved, a fusing temperature range may be sufficiently large, and preservation characteristics and the economical efficiency may be improved.

The releasing agent may be an ester group-containing wax. Examples of the ester group-containing wax include (1) mixtures including ester-based wax and non-ester based wax; and (2) an ester group-containing wax prepared by adding an ester group to a non-ester based wax.

Since an ester group has high affinity with respect to the binder component of toner, wax can be uniformly present among toner particles and the function of the wax is effectively exerted. Meanwhile, if only ester-based wax is used, excessive plasticizing reactions may occur. Thus, the inclusion of the non-ester based wax may result in prevention of such excessive plasticizing reactions due to a releasing reaction with respect to the binder. Therefore, development characteristics of toner can be maintained at appropriate levels for a long period of time.

Examples of the ester-based wax include esters of C15-C30 fatty acids and 1 to 5-valent alcohols, such as behenic acid behenyl, staric acid stearyl, stearic acid ester of pentaeritritol, or montanic acid glyceride. Also, if an alcohol component that forms ester is a monovalent alcohol, the number of carbon atoms may be in the range of 10 to 30, and if the alcohol component that forms ester is a polymeric alcohol, the number of carbon atoms may be in the range of 3 to 10.

The non-ester based wax may be polymethylene-based wax or paraffin-based wax.

Examples of the ester group-containing wax include: mixtures including paraffin-based wax and ester based wax; and ester group-containing paraffin-based wax. Examples of the ester group-containing wax also include P-280, P-318, and P-319 (manufactured by CHUKYO YUSHI CO., LTD.).

If the releasing agent is a mixture including paraffin-based wax and ester based wax, the amount of the ester-based wax of the releasing agent may be, for example, in the range of about 1 to about 35 weight %, about 3 to about 33 weight %, or about 5 to about 30 weight %, based on the total weight of the releasing agent.

If the amount of the ester-base wax is 1 wt % or more, compatibility of the ester-based wax with respect to the primary binder particle may be sufficiently maintained, and if the amount of the ester-base wax is 35 wt % or less, plasticizing characteristics of the toner are appropriately controlled and the toner retains development characteristics for a long period of time, and an offset-resistant property in a high temperature fusing latitude and gloss of toner may be improved.

Like the emulsifier used in the colorant dispersion, the emulsifier used in the releasing agent dispersion may be any emulsifier that is used in the art. Examples of the emulsifier used in the releasing agent dispersion may include an anionic reactive emulsifier, a non-ionic reactive emulsifier, and mixtures thereof. The anionic reactive emulsifier may be HS-10 (manufactured by DAI-ICHI KOGYO INC.), or Dawfax 2-A1 (manufactured by RHODIA INC.). The non-ionic reactive emulsifier may be RN-10 (manufactured by DAI-ICHI KOGYO INC.).

Due to the method described above, a molecular weight, Tg, and rheological characteristics of the primary binder particles are be appropriately controlled in such a way that the toner is fused at low temperature.

The primary binder particles, the colorant dispersion and the releasing agent dispersion as described above are mixed to obtain a mixed solution, and then an agglomerating agent is added to the mixed solution, thereby preparing an agglomerated toner. For example, the primary binder particles, the colorant dispersion, and the releasing agent dispersion are mixed and then the agglomerating agent is added thereto at a pH in the range of about 0.1 to about 2.0, thereby preparing the core layer forming particle having a particle size of 2.5 μm or less. Then, the secondary binder is added thereto and then a pH of the system used is controlled to be in the range of 6 to 8. Then, when a particle size of the resultant is maintained constant for a predetermined time period, the temperature is increased to 90 to 98° C. and the pH is decreased to 5 to 6 to coalesce the particles, thereby forming toner particles.

Examples of the agglomerating agent are NaCl, $MgCl_2$, $MgCl_2.8H20$, ferrous sulfate, ferric sulfate, ferric chloride, slaked lime, calcium carbonate, and Si and Fe-containing metallic salts, but are not limited thereto.

An amount of the agglomerating agent may be in a range of, for example, about 0.1 to about 10 parts by weight, about 0.5 to about 8 parts by weight, or about 1 to about 6 parts by weight, based on 100 parts by weight of the primary binder particle. If the amount of the agglomerating agent is less than 0.1 parts by weight, agglomeration efficiency may decrease, and if the amount of the agglomerating agent is 10 parts by weight or more, the electrification property of the toner may decrease and the geometric size distribution of the toner may be narrowed.

According to an embodiment of the present disclosure, the toner for developing an electrostatic latent image is prepared by using a Si and Fe-containing metallic salt as the agglomerating agent, and amounts of Si and Fe contained in the formed toner each are, for example, about 3 to about 30,000 ppm, about 30 to about 25,000 ppm, or about 300 to about 20,000 ppm. If the amounts of Si and Fe are less than 3 ppm, the addition effect may not be obtained, and if the amounts of Si and Fe are more than 30,000 ppm, the electrification property of the toner may decrease, and the interior of a printer housing the toner may be contaminated.

The Si and Fe-containing metallic salt may include, for example, polysilica iron, and in particular, due to collision between ionic strength that is increased by the addition of the Si and Fe-containing metallic salt in the toner manufacturing process according to an embodiment of the present disclosure and particles, the size of the primary agglomerated toner is increased. An example of the Si and Fe-containing metallic salt is a poly silica iron, and available examples of the Si and Fe-containing metallic salt may include model names PSI-025, PSI-050, PSI-085, PSI-100, PSI-200, PSI-300 (manufactured by SUIDO KIKO CO.). Table 1 blow shows physical properties and compositions of PSI-025, PSI-050, PSI-075, PSI-100, PSI-200, and PSI-300.

TABLE 1

| | | Type | | | | | |
|---|---|---|---|---|---|---|---|
| | | PSI-025 | PSI-050 | PSI-085 | PSI-100 | PSI-200 | PSI-300 |
| Si/Fe mole ratio | | 0.25 | 0.5 | 0.85 | 1 | 2 | 3 |
| Main component | Fe (wt %) | 5.0 | 3.5 | 2.5 | 2.0 | 1.0 | 0.7 |
| | $SiO_2$ (wt %) | 1.4 | 1.9 | 2.0 | | 2.2 | |
| pH (1w/v %) | | 2-3 | | | | | |
| Specific gravity (20° C.) | | 1.14 | 1.13 | 1.09 | 1.08 | 1.06 | 1.04 |
| Viscosity (mPa · S) | | 2.0 or more | | | | | |
| Average molecular weight (Dalton) | | 500,000 | | | | | |
| External appearance | | Yellowish brown transparent liquid | | | | | |

Since the Si and Fe-containing metallic salt is used as the agglomerating agent in the toner preparation process, the particle size may be reduced and the particle shape may also be controlled.

The agglomerating agent solution may have a pH of 2.0 or less, for example, a pH of 0.1 to 2.0, 0.3 to 1.8, or 0.5 to 1.6. In this case, if the pH of the agglomerating agent solution is less than 0.1, the agglomerating agent solution is too strong an acid and handling thereof is difficult, and if the pH of the agglomerating agent solution is more than 2.0, the iron added to the agglomerating agent may fail to control the odor of the chain transfer agent used in preparing latex, that is, a sulfur-containing compound, and agglomeration efficiency may be decreased.

The secondary binder particle may be obtained by polymerizing the one or more polymerizable monomers described above, and the polymerization may be emulsion polymerization dispersion, and may be performed to produce a particle having a size of about 1 μm or less, for example, a size of about 100 to about 300 nm. The secondary binder particle may also include a releasing agent, and the releasing agent may be included in the secondary binder particle during the polymerization.

In detail, the toner particle preparation method includes a) agglomerating the core layer forming particle and the shell layer forming particle in a temperature range in which the shear storage modulus (G') of each of the core layer forming particle and the shell layer forming particle is in a range of about $1.0\times10^8$ to about $1.0\times10^9$ Pa; b) stopping the agglomeration reaction when an average particle size of particles formed in the a) process is about 70 to about 100% of the toner particle; and c) fusing-coalescing particles obtained in the b) process in a temperature range in which the shear storage modulus (G') of the particles obtained in the b) process is in a range of about $1.0\times10^4$ to about $1.0\times10^9$ Pa.

The agglomeration of the core layer forming particle and the shell layer forming particle is a physical agglomeration process. Thus, if the agglomerating process is performed in the temperature range in which the shear storage modulus (G') of each of the core layer forming particle and the shell layer forming particle is in a range of about $1.0\times10^8$ to about $1.0\times10^9$ Pa, the premature fusion of the core layer forming particle and the shell layer forming particle may be prevented, and thus, the particle size distribution may be easily controlled.

The fusing-coalescing of the particles obtained in the b) process may be performed by heating in the temperature range in which the shear storage modulus (G') of particles obtained in the b) process is in a range of about $1.0\times10^4$ to about $1.0\times10^9$ Pa, that is, at a temperature that is 10 to 30° C. higher than a melting point of the particles obtained in the b) process.

That is, the secondary binder particle functioning as a shell layer is added to the core layer forming particle, and a pH of the reaction system is controlled to be in a range of about 6 to about 9. Then, once the particle size is maintained constant for a certain period of time, the temperature is increased to 90 to 98° C. and the pH is decreased to about 5 to about 6 to coalesce the particles, thereby completing the formation of a toner particle.

Also, the toner particle may be further covered by a tertiary binder particle prepared by polymerizing the one or more polymerizable monomers described above.

As such, by forming a shell layer by using the secondary binder particle or the secondary binder particle and the tertiary binder particle, durability of the toner is increased, and preservation of toner during shipping and handling is achievable. In this case, a polymerization inhibitor may be further used to prevent formation of a new binder particle, and also, a starved-feeding condition may be used to efficiently coat the toner with a monomer mixed solution.

The formed toner particle is filtered, isolated, and dried. The dried toner particle is treated with an external additive and an electrified charge amount thereof is controlled to produce a final dried toner.

As the external additive, a silicon-containing particle or a titanium-containing particle may be used.

The silicon-containing particle may include a large particle size silicon-containing particle including having a volume average particle size of about 30 to about 100 nm and a small particle size silicon-containing particle having a volume average particle size of about 5 to about 20 nm. An example of the silicon-containing particle is silica, and is not limited thereto.

The small particle size silicon-containing particle and the large particle size silicon-containing particle are added to provide a negative electrification property and a flowability. The large and small particle size silicon-containing particles may be prepared by performing a dry method using a halogenated product of silicon or by using a wet method, that is, by precipitating in a liquid from a silicon compound.

The large particle size silicon-containing particle may have a volume average particle size of about 30 to about 100 nm, and may promote separation between externally non-added toner particles, that is, toner mother particles, or between a toner mother particle and a surface thereof, and a small particle size silicon-containing particle may have a volume average particle size of about 5 to about 20 nm, and may provide flowability to the toner.

An amount of the large particle size silicon-containing particle may be in a range of, for example, about 0.1 to about 3.5 parts by weight, about 0.5 to about 3.0 parts by weight, or about 1.0 to about 2.5 parts by weight, based on 100 parts by weight of the toner mother particle. If the amount of the large particle size silicon-containing particle is in the range of about 0.1 to about 3.5 parts by weight, a fusing property decrease, over electrification, contamination, or filming may be prevented.

An amount of the small particle size silicon-containing particle may be in a range of, for example, about 0.1 to about 2.0 parts by weight, about 0.3 to about 1.5 parts by weight, or about 0.5 to about 1.0 parts by weight, based on 100 parts by weight of the toner mother particle. If the amount of the small particle size silicon-containing particle is in the range of about 0.1 to about 2.0 parts by weight, a fusing property may be improved, and over electrification and cleaning defects may be prevented.

As example of the titanium-containing particle is titanium dioxide, but is not limited thereto.

The titanium-containing particle increases an electrification amount and has excellent environmental characteristics. In particular, a toner charge up under low temperature and low humidity conditions may be prevented, and a toner charge down under high temperature and high humidity conditions may be prevented. Also, the flowability of toner may be improved, and when a great amount of toner is output for a long period of time, a high transfer efficiency may be sustained. A volume average particle size of the titanium-containing particle may be in a range of about 10 to about 200 nm. The volume average particle size of the titanium-containing particle may be in a range of, for example, about 0.1 to about 2.0 parts by weight, about 0.3 to about 1.5 parts by weight, or about 0.5 to about 1.0 parts by weight, based on 100 parts by weight of the toner mother particle. If the volume average particle size of the titanium-containing particle is in the range of about 0.1 to about 2.0 parts by weight, an electrification property maintenance with respect to the environment may be improved, and an image contamination and an electrification amount decrease may be prevented.

A method of forming an image according to another embodiment of the present disclosure includes forming a visible image by attaching a toner to a surface of a photoconductor on which an electrostatic image is formed and transferring the visible image onto a transfer medium, wherein the toner includes a binder including two different weight average molecular weight resins, a colorant, and a releasing agent, and a GPC distribution curve of the toner with respect to temperature has a major peak (Mp) present in a range of about $1.0\times10^4$ to about $3.0\times10^4$ g/mol and a shoulder starting point at $1.0\times10^5$ g/mol or more.

In general, an electrophotographic imaging method includes a electrifying process, an exposing process, a developing process, a transferring process, a fusing process, a cleaning process, and a charge-removing process, in order to form an image on a receptor.

In the electrifying process, a negative charge or a positive charge is applied to a photoconductor by corona or a electrifying roller. In the exposing process, the charged surface of the photoconductor is selectively discharged to form a latent image using an optical system such as a laser scanner or a diode arrangement. The latent image is formed in an image-wise manner such that the latent image corresponds to a desired image to be formed on a final image receptor. The optical system uses electromagnetic radiation, also referred to as "light," which may be infrared light radiation, visible light radiation, or ultra-violet light radiation.

In the developing process, particles of the toner having a sufficient polarity contact the latent image formed on the photoconductor, and conventionally, a developer having the same potential polarity as that of the toner, an electrically-biased developer, is used. The toner particles move toward the photoconductor and are selectively attached to the latent image of the photoconductor by an electrostatic force to thereby form a toner image on the photoconductor.

In the transferring process, the toner image is transferred from the photoconductor to a final image receptor. In some cases, an intermediate transferring element may be used to transfer the toner image from the photoconductor to the final image receptor.

In the fusing process, the toner image on the final image receptor is heated so that particles of the toner are softened or dissolved and are fixed to the final image receptor. Alternatively, the toner image may be fixed to the final image receptor by heating or by compression at high pressure without heating.

In the cleaning process, residual toner remaining on the photoconductor is removed.

Finally, in the charge-removing process, the charge of the photoconductor is exposed to light having a specific wavelength band and is thereby uniformly reduced to a low value. Therefore, the residue of the latent image may be removed and the photoconductor is made available for a further imaging cycle.

A toner supplying unit according to an embodiment of the present disclosure includes: a toner tank to store toner; a supplying part projecting inside the toner tank to discharge the toner from the toner tank; and a toner agitating member rotatably disposed inside the toner tank to agitate the toner in almost an entire inner space of the toner tank including a location on a top surface of the supplying part, wherein the toner includes a binder including two different weight average molecular weight resins, a colorant, and a releasing agent, and a GPC distribution curve of the toner has a major peak (Mp) present in a range of about $1.0\times10^4$ to about $3.0\times10^4$ g/mol and a shoulder starting point at $1.0\times10^5$ g/mol or more.

FIG. 1 is a view of a toner supplying apparatus 100 according to an embodiment of the present disclosure.

The toner supplying apparatus 100 includes a toner tank 101, a supplying part 103, a toner-conveying member 105, and a toner-agitating member 110.

The toner tank 101 stores a predetermined amount of toner and may be formed in a substantially hollow cylindrical shape.

The supplying part 103 is disposed at a bottom of the inside of the toner tank 101 and discharges the stored toner from the inside of the toner tank 101 to an outside of the toner tank 101. For example, the supplying part 103 may project from the bottom of the toner tank 101 to the inside of the toner tank 101 in a pillar shape with a semi-circular section. The supplying part 103 includes a toner outlet (not shown) to discharge the toner to an outer surface thereof.

The toner-conveying member 105 is disposed at a side of the supplying part 103 at the bottom of the inside of the toner tank 101. The toner-conveying member 105 may be formed in, for example, a coil spring shape. An end of the toner-conveying member 105 extends in an inside the supplying part 103 so that when the toner-conveying member 105 rotates, the toner in the toner tank 101 is conveyed to the inside of the supplying part 103. The toner conveyed by the toner-conveying member 105 is discharged to the outside through the toner outlet.

The toner-agitating member 110 is rotatably disposed inside the toner tank 101 and forces the toner in the toner tank 101 to move in a radial direction. For example, when the toner-agitating member 110 rotates at a middle of the toner tank 101, the toner in the toner tank 101 is agitated to prevent the toner from solidifying. As a result, the toner moves down to the bottom of the toner tank 101 by its own weight. The toner-agitating member 110 includes a rotation shaft 112 and a toner agitating film 120. The rotation shaft 112 is rotatably disposed at the middle of the toner tank 101 and has a driving gear (not shown) coaxially coupled with an end of the rotation shaft 112 projecting from a side of the toner tank 101. Therefore, the rotation of the driving gear causes the rotation shaft 112 to rotate. Also, the rotation shaft 112 may have a wing plate 114 to help fix the toner agitating film 120 to the rotation shaft 112. The wing plate 114 may be formed to be substantially symmetric about the rotation shaft 112. The toner agitating film 120 has a width corresponding to the inner length of the toner tank 101. Furthermore, the toner agitating film 120 may be elastically deformable. For example, the toner agitating film 120 may bend toward or away from a projection inside the toner tank 101, i.e., the supplying part 103.

Portions of the toner agitating film 120 may be cut off from the toner agitating film 120 toward the rotation shaft 112 to form a first agitating part 121 and a second agitating part 122.

An imaging apparatus according to an embodiment of the present disclosure includes: a photoconductor; an image forming unit that forms an electrostatic latent image on a surface of the photoconductor; a unit receiving a toner, a toner supplying unit that supplies the toner onto the surface of the photoconductor to develop the electrostatic latent image on the surface of the photoconductor into a toner image; and a toner transferring unit that transfers the toner image to a transfer medium from the surface of the photoconductor, wherein the toner includes a binder including two different weight average molecular weight resins, a colorant, and a releasing agent, and a GPC distribution curve of the toner has a major peak (Mp) present in a range of about $1.0\times10^4$ to about $3.0\times10^4$ g/mol and a shoulder starting point at $1.0\times10^5$ g/mol or more.

Figure 2:
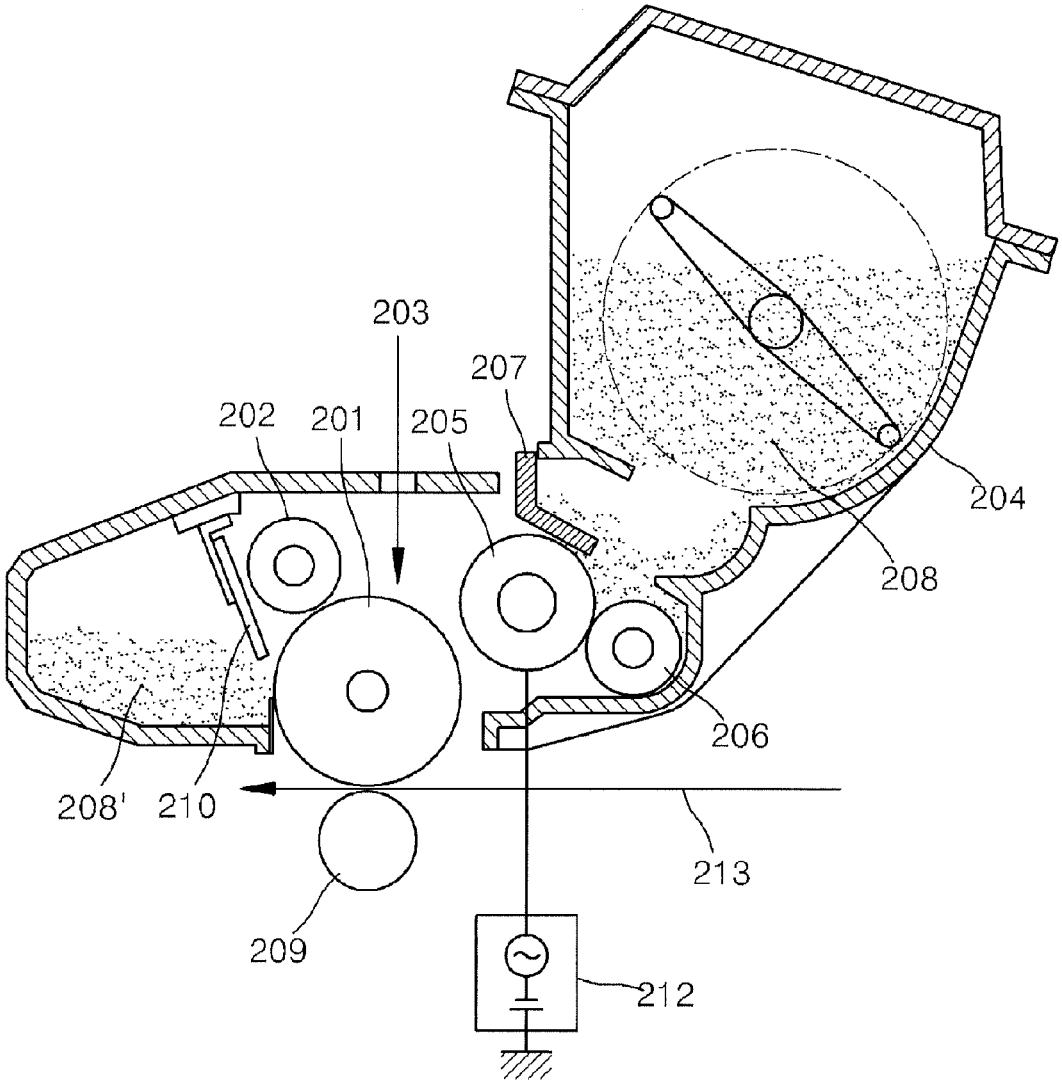
FIG. 2 is a view of an example of an image forming apparatus for housing a toner according to an embodiment of the present disclosure.

FIG. 2 is a view of a non-contact development type imaging apparatus including toner prepared using a method according to an embodiment of the present disclosure.

A developer (for example, toner) 208 which includes a nonmagnetic one-component of a developing device 204 is supplied to a developing roller 205 by a supply roller 206 formed of an elastic material, such as polyurethane foam or sponge. The developer 208 supplied to the developing roller 205 reaches a contact portion between a developer controlling blade 207 and the developing roller 205 due to rotation of the developing roller 205. The developer controlling blade 207 may be formed of an elastic material, such as metal or rubber. When the developer 208 passes through the contact portion between the developer controlling blade 207 and the developing roller 205, the developer 208 is controlled and formed into a thin layer which has a uniform thickness and is sufficiently charged. The developer 208 which has been formed into a thin layer is transferred to a development region of a photoconductor 201 that is a photoconductor, in which a latent image is developed by the developing roller 205. At this time, the latent image is formed by scanning light 203 to the photoconductor 201.

The developing roller 205 is separated from the photoconductor 201 by a predetermined distance and faces the photoconductor 201. The developing roller 205 rotates in a counterclockwise direction, and the photoconductor 201 rotates in a clockwise direction.

The developer 208 which has been transferred to the development region of the photoconductor 201 develops the latent image formed on the photoconductor 201 by an electric force generated by a potential difference between a direct current (DC) biased alternating current (AC) voltage 212 applied to the developing roller 205 and a latent potential of the photoconductor 201 charged by a electrifying unit 202 so as to form a toner image.

The developer 208, which has been transferred to the photoconductor 201, reaches a transfer unit 209 due to the rotation direction of the photoconductor 201. The developer 208, which has been transferred to the photoconductor 201, is transferred to a print medium 213 to form an image by the transfer unit 209 having a roller shape and to which a high voltage having a polarity opposite to the developer 208 is applied, or by corona diselectrifying when the print medium 213 passes between the photoconductor 201 and the transfer unit 209.

The image transferred to the print medium 213 passes through a high temperature and high pressure fusing device (not shown) and thus the developer 208 is fused to the print medium 213 to form the image. Meanwhile, a non-developed, residual developer 208' on the developing roller 205 is collected by the supply roller 206 to contact the developing roller 205, and the non-developed, residual developer 208' on the photoconductor 201 is collected by a cleaning blade 210. The processes described above are repeated.

The present inventive concept will now be described in further detail with reference to the following examples. These examples are for illustrative purposes only and are not intended to limit the scope of the present inventive concept.

SEM images of toners prepared according to the following examples were obtained to identity shapes of the toners. The circularity of the toners may be measured using an FPIA-3000 apparatus produced by SYSMEX Co., Inc. using the equation below:

$$\text{Circularity}=2\times(\pi\times\text{area})^{0.5}/\text{circumference}. \quad \text{<Equation>}$$

Synthesis of Low Molecular Weight Resin Latex (L-LTX)

PREPARATION EXAMPLE 1

Synthesis of (L-LTX-15K-Tg60)

A polymerizable monomer mixed solution (including 825 g of styrene and 175 g of n-butyl acrylate), 30 g of beta-carboxyethylacrylate (SIPOMER, RHODIA), 25 g of 1-dodecanthiol constituting a chain transfer agent (CTA), and 418 g of sodium dodecyl sulfate (ALDRICH) aqueous solution (2% with respect to water) constituting an emulsifier were added to a 3 L beaker and the mixture was stirred to prepare a polymerizable monomer emulsified solution. 16 g of ammonium persulfate (APS) constituting an initiator and 696 g of a sodium dodecyl sulfate (ALDRICH) aqueous solution (0.4% with respect to water) constituting an emulsifier were added to a 3 L double jacket reactor that had been heated to 75° C., and the prepared polymerizable monomer emulsified solution was slowly dropped thereto while stirring for 2 or more hours. The reaction was performed at a temperature of 75° C. for 8 hours. The size of the prepared resin latex particle measured by using a light scattering method (HORIBA LA-910) was in a range of 180 to 250 nm. A weight average molecular weight (Mw) thereof measured by gel permeation chromatography with respect to a tetrahydrofurane (THF)-soluble material was 15,000 g/mol. A glass transition temperature thereof measured by twice scanning using a DSC (PERKINELMER) at a temperature increase rate of 10° C./min was 60° C.

PREPARATION EXAMPLE 2

Synthesis of (L-LTX-15K-Tg58)

A low molecular weight resin latex was synthesized in the same manner as in Preparation Example 1, except that the monomer mixed solution consisted of 810 g of styrene and 190 g of n-butyl acrylate. The size of the synthesized resin latex particle measured by using a light scattering-type HORIBA 910 was in a range of 180 to 250 nm. A weight average molecular weight (Mw) thereof measured by gel permeation chromatography with respect to a tetrahydrofurane (THF)-soluble material was 15,000 g/mol. A glass transition temperature thereof measured by twice scanning using a DSC (PERKINELMER) at a temperature increase rate of 10° C./min was 58° C.

PREPARATION EXAMPLE 3

Synthesis of (L-LTX-15K-Tg55)

A low molecular weight resin latex was synthesized in the same manner as in Preparation Example 1, except that the monomer mixed solution consisted of 790 g of styrene and 210 g of n-butyl acrylate. The size of the synthesized resin latex particle measured by using a light scattering-type HORIBA 910 was in a range of 180 to 250 nm. A weight average molecular weight (Mw) thereof measured by gel permeation chromatography with respect to a tetrahydrofurane (THF)-soluble material was 15,000 g/mol. A glass transition temperature thereof measured by twice scanning using a DSC (PERKINELMER) at a temperature increase rate of 10° C./min was 55° C.

PREPARATION EXAMPLE 4

Synthesis of (L-LTX-15K-Tg70)

A low molecular weight resin latex was synthesized in the same manner as in Preparation Example 1, except that the monomer mixed solution consisted of 900 g of styrene and 100 g of n-butyl acrylate. The size of the synthesized resin latex particle measured by using a light scattering-type HORIBA 910 was in a range of 180 to 250 nm. A weight average molecular weight (Mw) thereof measured by gel permeation chromatography with respect to a tetrahydrofurane (THF)-soluble material was 15,000 g/mol. A glass transition temperature thereof measured by twice scanning using a DSC (PERKINELMER) at a temperature increase rate of 10° C./min was 70° C.

PREPARATION EXAMPLE 5

Synthesis of (L-LTX-25K-Tg60)

A low molecular weight resin latex was synthesized in the same manner as in Preparation Example 1, except that the monomer mixed solution consisted of 790 g of styrene and 210 g of n-butyl acrylate, and 14.3 g of 1-dodecanthiol was used as a chain transfer agent (CTA). The size of the synthesized latex particle measured by using a light scattering-type HORIBA 910 was in a range of 180 to 250 nm. A weight average molecular weight (Mw) thereof measured by gel permeation chromatography with respect to a tetrahydrofurane (THF)-soluble material was 25,000 g/mol. A glass transition temperature thereof measured by twice scanning using a DSC (PERKINELMER) at a temperature increase rate of 10° C./min was 60° C.

PREPARATION EXAMPLE 6

Synthesis of (L-LTX-25K-Tg63)

A low molecular weight resin latex was synthesized in the same manner as in Preparation Example 1, except that the monomer mixed solution consisted of 813 g of styrene and 187 g of n-butyl acrylate. The size of the synthesized latex particle measured by using a light scattering-type HORIBA 910 was in a range of 180 to 250 nm. A weight average molecular weight (Mw) thereof measured by gel permeation chromatography with respect to a tetrahydrofurane (THF)-soluble material was 25,000 g/mol. A glass transition temperature thereof measured by twice scanning using a DSC (PERKINELMER) at a temperature increase rate of 10V/min was 63° C.

PREPARATION EXAMPLE 7

Synthesis of (L-LTX-70K-Tg60)

A low molecular weight resin latex was synthesized in the same manner as in Preparation Example 1, except that the monomer mixed solution consisted of 760 g of styrene and 240 g of n-butyl acrylate and 7.2 g of 1-dodecanthiol was used as a chain transfer agent (CTA). The size of the synthesized latex particle measured by using a light scattering-type HORIBA 910 was in a range of 180 to 250 nm. A weight average molecular weight (Mw) thereof measured by gel permeation chromatography with respect to a tetrahydrofurane (THF)-soluble material was 70,000 g/mol. A glass transition temperature thereof measured by twice scanning using a DSC (PERKINELMER) at a temperature increase rate of 10° C./min was 60° C.

<Synthesis of High Molecular Weight Resin Latex (H-LTX)>

PREPARATION EXAMPLE 8

Synthesis of (H-LTX-580K)

A polymerizable monomer mixed solution (including 685 g of styrene and 315 g of n-butyl acrylate), 30 g of beta-carboxyethylacrylate (SIPOMER, RHODIA), and 418 g of a sodium dodecyl sulfate (ALDRICH) aqueous solution (2% with respect to water) constituting an emulsifier were added to a 3 L beaker and the mixture was stirred to prepare a polymerizable monomer emulsified solution. 5 g of ammonium persulfate (APS) constituting an initiator and 696 g of a sodium dodecyl sulfate (ALDRICH) aqueous solution (0.4% with respect to water) constituting an emulsifier were added to a 3 L double jacket reactor that had been heated to 60° C., and the prepared polymerizable monomer emulsified solution was slowly dropped thereto while stirring for 3 hours or more. The reaction was performed at a temperature of 60° C. for 8 hours. The size of the synthesized latex particle measured by using a light scattering-type HORIBA 910 was in a range of 180 to 250 nm. A weight average molecular weight (Mw) thereof measured by gel permeation chromatography with respect to a tetrahydrofurane (THF)-soluble material was 580,000 g/mol. A glass transition temperature thereof measured by twice scanning using a DSC (PERKINELMER) at a temperature increase rate of 10° C./min was 53° C.

PREPARATION EXAMPLE 9

Synthesis of (H-LTX-350K)

A high molecular weight resin latex was synthesized in the same manner as in Preparation Example 8, except that 10 g of ammonium persulfate (APS) was used as an initiator and the reaction temperature was 70° C. The size of the synthesized latex particle measured by using a light scattering-type HORIBA 910 was in a range of 180 to 250 nm. A weight average molecular weight (Mw) thereof measured by gel permeation chromatography with respect to a tetrahydrofurane (THF)-soluble material was 350,000 g/mol. A glass transition temperature thereof measured by twice scanning using a DSC (PERKINELMER) at a temperature increase rate of 10° C./min was 53° C.

PREPARATION EXAMPLE 10

Synthesis of (H-LTX-250K)

A high molecular weight resin latex was synthesized in the same manner as in Preparation Example 8, except that the reaction temperature was 75° C. The size of the synthesized latex particle measured by using a light scattering-type HORIBA 910 was in a range of 180 to 250 nm. A weight average molecular weight (Mw) thereof measured by gel permeation chromatography with respect to a tetrahydrofurane (THF)-soluble material was 250,000 g/mol. A glass transition temperature thereof measured by twice scanning using a DSC (PERKINELMER) at a temperature increase rate of 10° C./min was 53° C.

Preparation of Toner Colorant Dispersion 10 g of sodium dodecyl sulfate (ALDRICH) constituting an anionic reactive emulsifier and 60 g of a carbon black (Mogul-L) colorant were loaded into a milling bath, and 400 g of glass beads having a diameter of 0.8 to 1 mm was added thereto, followed by milling at room temperature, thereby preparing a dispersion. A homogenizer used in this experiment was an ultrasonic homogenizer (SONICS AND MATERIALS, VCX750).

Preparation of Toner for Developing Electrostatic Latent Image

EXAMPLE 1

Preparation of Toner 344 g (0.3 mol) of a nitric acid and 172 g of PSI-100 (manufactured by SUIDO KIKO CO.) constituting an agglomerating agent were added to a mixed solution including 3,000 g of deionized water, 1100 g of a mixed solution (L-LTX-15K-Tg60 93% was mixed with H-LTX-580K 7% (weight ratio)) of the resin latex synthesized according to Preparation Examples 1 and 8 as a primary binder particle, and 250 g of a carbon black pigment dispersion, and 250 g of P-420 (CHUKYO YUSHI CO., LTD., paraffin wax 25-35%, synthesized ester wax 5-10%, viscosity (25° C.) 13 mPa-s, melting point of 89° C.) constituting a releasing agent dispersion in a 7 L reactor, and stirred by using a homogenizer at a rate of 11,000 rpm for 6 minutes, thereby producing a core layer forming particle having a volume average particle size of 1.5 to 2.5 μm. The resultant mixed solution was loaded into a 7 L double jacket reactor and the temperature thereof was increased from room temperature to 55° C. (Tg of the latex −5° C. or more) at a temperature increase rate of 0.5° C. per minute. When the volume average particle size of the core layer forming particle was about 6.0 μm, 419 g of a mixed solution (including L-LTX-15K-Tg60 93% and H-LTX-580K 7% (weight ratio)) of the resin latex synthesized according to Preparation Examples 1 and 4 was additionally slowly added thereto for 20 minutes. When the volume average particle size was 6.8 μm, NaOH (1 mol) was added thereto and a pH thereof was adjusted to be 7. When the volume average particle size was maintained constant for 10 minutes, the temperature was increased to 96° C. at a temperature increase rate of 0.5° C. per minute. When the temperature was 96° C., a nitric acid (0.3 mol) was added thereto to adjust a pH thereof to be 6.0, and then coalescing was performed thereon for about 3 to about 5 hours, thereby producing a potato-shaped toner particle having a volume average particle size of about 6.5 to about 7.0 μm. Then, the agglomeration reaction solution was cooled to a temperature lower than Tg, followed by filtering to isolate the toner particle and drying.

To 100 parts by weight of the dried toner particle, 0.5 parts by weight of NX-90 (NIPPON AEROSIL), 1.0 parts by weight of RX-200 (NIPPON AEROSIL), and 0.5 parts by weight of SW-100 (TITAN KOGYO) were externally added in a mixer (KM-LS2K, DAE WHA TECH) and the mixture was stirred at a rotation speed of 8000 rpm for 4 minutes.

EXAMPLE 2

Toner was prepared in the same manner as in Example 1 except that the resin latex mixed solution consisted of L-LTX-15K-Tg60 90% and H-LTX-580K 10%.

EXAMPLE 3

Toner was prepared in the same manner as in Example 1 except that the resin latex mixed solution consisted of L-LTX-15K-Tg60 85% and H-LTX-580K 15%.

EXAMPLE 4

Toner was prepared in the same manner as in Example 1 except that the resin latex mixed solution consisted of L-LTX-25K-Tg63 93% and H-LTX-250K 7% respectively synthesized according to Preparation Examples 6 and 10.

EXAMPLE 5

Toner was prepared in the same manner as in Example 1 except that the resin latex mixed solution consisted of L-LTX-25K-Tg63 93% and H-LTX-350K 7% respectively synthesized according to Preparation Examples 6 and 9.

EXAMPLE 6

Toner was prepared in the same manner as in Example 1 except that the resin latex mixed solution consisted of L-LTX-25K-Tg63 97% and H-LTX-250K 3% respectively synthesized according to Preparation Examples 6 and 10.

EXAMPLE 7

Toner was prepared in the same manner as in Example 1 except that the resin latex mixed solution consisted of L-LTX-25K-Tg63 95% and H-LTX-250K 5% respectively synthesized according to Preparation Examples 6 and 10.

EXAMPLE 8

Toner was prepared in the same manner as in Example 1 except that the resin latex mixed solution consisted of L-LTX-15K-Tg60 95% and H-LTX-580K 5% respectively synthesized according to Preparation Examples 1 and 8.

EXAMPLE 9

Toner was prepared in the same manner as in Example 1 except that the resin latex mixed solution consisted of L-LTX-25K-Tg60 93% and H-LTX-580K 7% respectively synthesized according to Preparation Examples 5 and 8.

EXAMPLE 10

Toner was prepared in the same manner as in Example 1 except that the resin latex mixed solution consisted of L-LTX-15K-Tg60 93% and H-LTX-350K 7% respectively synthesized according to Preparation Examples 1 and 9.

EXAMPLE 11

Toner was prepared in the same manner as in Example 1 except that the resin latex mixed solution consisted of L-LTX-25K-Tg60 93% and H-LTX-350K 7% respectively synthesized according to Preparation Examples 5 and 9.

EXAMPLE 12

Toner was prepared in the same manner as in Example 1 except that the resin latex mixed solution consisted of L-LTX-25K-Tg60 91.5% and H-LTX-250K 8.5% respectively synthesized according to Preparation Examples 5 and 9.

COMPARATIVE EXAMPLE 1

Toner was prepared in the same manner as in Example 1 except that the resin latex mixed solution consisted of only L-LTX-15K-Tg60.

COMPARATIVE EXAMPLE 2

Toner was prepared in the same manner as in Example 1 except that the resin latex mixed solution consisted of only L-LTX-25K-Tg60.

COMPARATIVE EXAMPLE 3

Toner was prepared in the same manner as in Example 1 except that the resin latex mixed solution consisted of only LTX-70K-Tg60.

COMPARATIVE EXAMPLE 4

Toner was prepared in the same manner as in Example 1 except that the resin latex mixed solution consisted of LTX-15K-Tg70 93% and LTX-580K-Tg53 7% respectively synthesized according to Preparation Examples 4 and 8.

Toner Evaluation

<Weight Average Molecular Weight and Z Average Molecular Weight Evaluation>

The weight average molecular weight (Mw) and Z average molecular weight (Mz) of toner were evaluated by gel permeation chromatography (GPC, Alliance Inc.). RI detector Waters 2414 was used as a detector, three columns of Strygel HR 5, 4, and 2 were used. As a mobile phase, tetrahydrofurane was used at a flow rate of 1 ml/min. A concentration of a measurement sample was 1%, and a loading volume was 50 ul. 10 reference samples were used for correction and a concentration of each of the reference samples was 0.5%. Solutions of the respective reference samples have the following conditions:

Reference sample 1 solutions: molecular weight: 1,200/7,210/196,000/257,000/1,320,000/THF at a mixed volume ratio of 1:1:1:1:0.5:0.5.

Reference sample 2 solutions: molecular weight: 3,070/49,200/113,000/778,000/3,150,000/THF at a mixed volume ratio of 1:1:1:1:0.5:0.5.

<Fluorescent X-Ray Evaluation>

X-ray fluorescence measurement of each of the samples was performed using an energy dispersive X-ray spectrometer (EDX-720) produced by SHIMADZU Co. An X-ray tube voltage was 50 kV, and amounts of samples that were molded were 3 g±0.01 g. For each sample, [Zn]/[Fe] and [Si]/[Fe] were calculated using intensity (unit: cps/uA) obtained from amounts obtained by X-ray fluorescence measurement.

<Fusing Characteristics Evolution>

Fusing Jig apparatus: 2-roll-type fusing device (Nip of 11 mm, pressure of 14.5 kgf)

non-fused image for test: 100% pattern test temperature: 120~210° C.

test paper sheet: 60 g of paper sheet (X-9 manufactured by BOISE CO., LTD.) and 90 g of paper sheet ((Exclusive manufactured by XEROX CO, LTD.)

fusing speed: 320 mm/sec (55 ppm)

The experiment was performed under the conditions described above, and then a fusing property of the fused image was evaluated as follows.

After OD of the fused image was measured, a 3M 810 tape was attached to the image and 500 g of a pendulum was moved back and forth thereon five times and the tape was removed therefrom. Then, OD of the fused image after the removal of the tape was measured.

Fusing property (%)=(OD_after tape peeling/OD_before tape peeling)×100

A fusing temperature region in which a fusing property is 80% or more is regarded as a toner fusing region.

MFT: Minimum Fusing Temperature [a minimum temperature at which a fusing property is 80% or more with a cold offset], 90 g of a fusing paper sheet (XEROX CO., LTD. Exclusive)

HOT: HOT Offset Temperature [a minimum temperature at which a hot offset occurs]

<Gloss Evaluation>

Gloss was measured as follows: an image was printed by using a color laser printer (Manufacturer: Samsung Electronics Co., Ltd., and Product name: color laser CLP 320 model), and gloss of the image was measured by using a Glossmeter (Manufacturer: BYK GARDNER, product name: micro-TR1-gloss), which is a device for measuring gloss.

Measurement angle: 60°

Measurement pattern: 100% pattern

Measurement paper sheet: 80 g of paper sheet (XEROX CO., LTD., double A)

Evaluation References

⊙: 10 or more

○: 7~10

Δ: 3~7

X: 3 or less

<High Temperature Preservation Evaluation>

External additives were added to 100 g of toner, and then the toner was added to a developing device (Manufacturer: Samsung Electronics Co., Ltd, product name: color laser CLP 320 model) and was, in its packaged state, preserved in a constant-temperature and constant-humidity oven under the following conditions.

23° C., 55% relative humidity (RH) 2 hours

=>40° C., 90% RH 48 hours

=>50° C., 80% RH 48 hours

=>40° C., 90% RH 48 hours

=>23° C., 55% RH 6 hours

After the preservation under the above conditions, it was confirmed with the naked eye whether toner caking in the developing device occurs, and then, 100% image was printed to evaluate an image defect.

Evaluation Reference

○: good image, no caking

□: image defect, no caking

X: caking

TABLE 2

| | Major peak location (Mp, g/mol) | Shoulder starting point (g/mol) | Ts (° C.) | Weight average molecular weight of toner (Mw, g/mol) | Z average molecular weight of toner (Mz, g/mol) | Toner Tg (° C.) |
|---|---|---|---|---|---|---|
| Example 1 | 14,581 | 159,000 | 56.82 | 40,279 | 696,114 | 57 |
| Example 2 | 15,189 | 155,000 | 56.99 | 41,289 | 629,185 | 57 |
| Example 3 | 15,079 | 131,000 | 57.29 | 59,365 | 971,844 | 57 |
| Example 4 | 23,276 | 154,000 | 59.29 | 73,237 | 3,818,064 | 59 |
| Example 5 | 23,404 | 175,000 | 60.81 | 77,538 | 446,608 | 60 |
| Example 6 | 22,717 | 176,000 | 58.96 | 63,415 | 3,692,840 | 59 |
| Example 7 | 22,841 | 197,000 | 58.98 | 70,548 | 3,586,401 | 59 |
| Example 8 | 14,712 | 172,000 | 56.16 | 30,954 | 397,496 | 56 |

TABLE 2-continued

| | Major peak location (Mp, g/mol) | Shoulder starting point (g/mol) | Ts (° C.) | Weight average molecular weight of toner (Mw, g/mol) | Z average molecular weight of toner (Mz, g/mol) | Toner Tg (° C.) |
|---|---|---|---|---|---|---|
| Example 9 | 22,726 | 182,000 | 57.22 | 81,514 | 5,698,274 | 57 |
| Example 10 | 14,233 | 134,000 | 56.28 | 38,462 | 550,926 | 56 |
| Example 11 | 21,967 | 190,000 | 57.24 | 77,695 | 4,618,707 | 57 |
| Example 12 | 21,189 | 242,000 | 53.36 | 69,757 | 2,979,981 | 55 |
| Comparative Example 1 | 15,720 | No shoulder | 57.88 | 20,572 | 55,639 | 57 |
| Comparative Example 2 | 22,609 | No shoulder | 57.77 | 34,815 | 209,665 | 57 |
| Comparative Example 3 | 59,317 | No shoulder | 57.02 | 87,080 | 379,289 | 57 |
| Comparative Example 4 | 14,751 | 157,000 | 67.01 | 41,205 | 656,102 | 67 |

TABLE 3

| | [Log G'(80) − Log G'(100)]/20 (S1) | [Log G'(110) − Log G'(160)]/50 (S2) | S1/S2 | G'(160) (Pa) | MFT (° C.) | HOT (° C.) | HOT − MFT (° C.) | Gloss | High temperature preservation |
|---|---|---|---|---|---|---|---|---|---|
| Example 1 | 0.057 | 0.0211 | 2.71 | 624.747 | 142 | 200 | 58 | ○ | ○ |
| Example 2 | 0.054 | 0.0201 | 2.69 | 913.529 | 138 | 220 | 82 | ○ | ○ |
| Example 3 | 0.049 | 0.0167 | 2.93 | 1936.092 | 134 | 240 | 106 | Δ | ○ |
| Example 4 | 0.053 | 0.0276 | 1.92 | 328.617 | 148 | 205 | 57 | ◎ | ○ |
| Example 5 | 0.054 | 0.0267 | 2.02 | 533.890 | 148 | 200 | 52 | ○ | ○ |
| Example 6 | 0.057 | 0.0323 | 1.78 | 178.710 | 146 | 200 | 54 | ◎ | ○ |
| Example 7 | 0.059 | 0.0318 | 1.80 | 266.396 | 149 | 200 | 51 | ◎ | ○ |
| Example 8 | 0.059 | 0.0251 | 2.36 | 245.741 | 139 | 200 | 61 | ◎ | ○ |
| Example 9 | 0.051 | 0.0279 | 1.81 | 553.456 | 138 | 205 | 67 | ○ | ○ |
| Example 10 | 0.057 | 0.0291 | 1.94 | 184.759 | 135 | 200 | 65 | ◎ | ○ |
| Example 11 | 0.051 | 0.0283 | 1.79 | 477.946 | 140 | 205 | 65 | ○ | ○ |
| Example 12 | 0.056 | 0.0260 | 2.15 | 329.512 | 130 | 205 | 75 | ◎ | ○ |
| Comparative Example 1 | 0.069 | 0.0488 | 1.41 | 28.884 | 125 | 160 | 35 | ◎ | ○ |
| Comparative Example 2 | 0.058 | 0.0422 | 1.37 | 53.397 | 139 | 165 | 26 | ◎ | ○ |
| Comparative Example 3 | 0.038 | 0.0386 | 0.97 | 1309.770 | 154 | 210 | 56 | Δ | ○ |
| Comparative Example 4 | 0.058 | 0.0250 | 2.30 | 715.225 | 160 | 200 | 40 | Δ | ○ |

Table 4 shows an amount of a fraction of $5\times10^6$ g/mol or more, an amount of a fraction of $1\times10^6$ g/mol or more and less than $5\times10^6$ g/mol, an amount of a fraction of $1\times10^5$ g/mol or more and less than $5\times10^5$ g/mol, and an amount of a fraction of less than $2\times10^4$ g/mol of toner prepared according to Examples and Comparative Examples.

TABLE 4

| | Amount of fraction of $5 \times 10^6$ g/mol or more (wt %) | Amount of fraction of $1 \times 10^6$ g/mol or more and less than $5 \times 10^6$ g/mol (wt %) | Amount of fraction of $1 \times 10^5$ g/mol or more and less than $5 \times 10^5$ g/mol (wt %) | Amount of fraction of less than $2 \times 10^4$ g/mol (wt %) |
|---|---|---|---|---|
| Example 1 | 0.15 | 0.627 | 3.55 | 66.36 |
| Example 2 | 0.41 | 0.90 | 4.15 | 68.46 |
| Example 3 | 0.12 | 1.50 | 4.17 | 65.68 |
| Example 4 | 0.56 | 0.97 | 5.33 | 52.85 |

TABLE 4-continued

| | Amount of fraction of $5 \times 10^6$ g/mol or more (wt %) | Amount of fraction of $1 \times 10^6$ g/mol or more and less than $5 \times 10^6$ g/mol (wt %) | Amount of fraction of $1 \times 10^5$ g/mol or more and less than $5 \times 10^5$ g/mol (wt %) | Amount of fraction of less than $2 \times 10^4$ g/mol (wt %) |
|---|---|---|---|---|
| Example 5 | 0.18 | 0.78 | 5.27 | 47.70 |
| Example 6 | 0.11 | 0.41 | 3.79 | 50.68 |
| Example 7 | 0.54 | 0.89 | 4.94 | 47.52 |
| Example 8 | 0.035 | 0.42 | 2.474 | 70.21 |
| Example 9 | 0.073 | 0.15 | 2.57 | 69.20 |
| Example 10 | 0.12 | 0.61 | 4.06 | 68.24 |
| Example 11 | 0.19 | 0.77 | 5.29 | 47.59 |
| Example 12 | 0.13 | 0.85 | 4.79 | 47.87 |
| Comparative Example 1 | 0.10 | 0.16 | 2.35 | 82.51 |
| Comparative Example 2 | 0.15 | 0.32 | 2.83 | 61.57 |

TABLE 4-continued

| | Amount of fraction of $5 \times 10^6$ g/mol or more (wt %) | Amount of fraction of $1 \times 10^6$ g/mol or more and less than $5 \times 10^6$ g/mol (wt %) | Amount of fraction of $1 \times 10^5$ g/mol or more and less than $5 \times 10^5$ g/mol (wt %) | Amount of fraction of less than $2 \times 10^4$ g/mol (wt %) |
|---|---|---|---|---|
| Comparative Example 3 | 0.22 | 1.11 | 19.52 | 27.78 |
| Comparative Example 4 | 0.15 | 0.63 | 3.55 | 66.36 |

Regarding toners prepared according to Examples 1 to 12 and Comparative Examples 1 to 4, as XRF analysis results, an intensity ratio of sulfur (S) to iron (Fe), that is, [S]/[Fe] was in a range of 0.003 to 0.01. Also, volume average particle sizes of all the toners were in a range of 6.5 to 7.0 μm, and each of GSDp and GSDv was in a range of 1.2 to 1.3. In addition, the average circularity of each of the toners was in a range of 0.970 to 0.980.

Referring to Tables 2 and 3 above, it was confirmed that toners prepared according to Examples 1 to 12 had better gloss, fusing, and high temperature preservation characteristics than those prepared according to Comparative Example 1 to 4 which do not have toner molecular weight characteristics according to an embodiment of the present disclosure. That is, Comparative Examples 1 to 4 employ different molecular weights and mixed ratios of a low molecular weight and a high molecular weight resin latex.

As shown in Tables 2 and 3 above, all the toners prepared according to Examples 1 to Example 12 which satisfy the conditions according to the present disclosure with respect to the major peak location, the shoulder starting point, and Ts showed excellent gloss and fusing characteristics, and high temperature preservation.

As shown in Tables 2 and 4 above, all the toners prepared according to Examples 1 to Example 12 in which the amount of the fraction of 5×106 g/mol or more is about 0.1 to 1.0 wt %, the amount of the fraction of 1×106 g/mol or more and less than 5×106 g/mol is in a range of about 0.5 to about 3.0 wt %, the amount of the fraction of 1×105 g/mol or more and less than 5×105 g/mol is in a range of about 3.0 to about 10 wt %, and the amount of the fraction of less than 2×104 g/mol is in a range of about 45 to about 70 wt % satisfy the conditions according to the present disclosure with respect to the major peak location, the shoulder starting point, and Ts, and show excellent gloss and fusing characteristics, and high temperature preservation.

While the present disclosure has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. A toner to develop an electrostatic latent image, the toner comprising:

a binder including at least two resins which have a different weight-average molecular weight from each other, a colorant, and a releasing agent, wherein a gel permeation chromatogram (GPC) molecular weight distribution curve of the toner has a major peak (Mp) present in a range of about $1.0\times10^4$ to about $3.0\times10^4$ g/mol and a shoulder curve starting at about $1.0\times10^5$ g/mol or more, and a storage modulus (G') curve of the toner with respect to temperature has Ts, which is a temperature at which a storage modulus value begins to decrease, in a temperature range of about 50 to about 67° C.;

wherein the at least two resins comprises a high molecular weight resin having an average molecular weight in a range from about $1.0*10^5$ to $5.0*10^5$ g/mol and a low molecular weight resin having an average molecular weight in a range from about $1.3*10^4$ to $3.0*10^4$ g/mol.

2. The toner of claim 1, wherein in the GPC molecular weight distribution of the toner, an amount of a fraction of $5\times10^6$ g/mol or more in the toner is in a range of about 0.1 to about 1.0 wt %, an amount of a fraction of $1\times10^6$ g/mol or more and less than $5\times10^6$ g/mol in the toner is in a range of about 0.5to about 3.0 wt %, an amount of a fraction of $1\times10^5$ g/mol or more and less than $5\times10^5$ g/mol in the toner is in a range of about 3.0 to about 10 wt %, and an amount of a fraction of less than $2\times10^4$ g/mol in the toner is in a range of about 45 to about 70 wt %.

3. The toner of claim 1, wherein the toner has a weight average molecular weight of about $3.0\times10^4$ to about $5.0\times10^5$ g/mol and a Z average molecular weight of about $1.0\times10^6$ to about $5.0\times10^7$ g/mol.

4. The toner of claim 1, wherein the storage modulus (G') curve of the toner with respect to temperature, S1(=[Log G'(80) − Log G'(100)]/20) is in a range of about 0.03 to about 0.1, S2(=[Log G'(110) − Log G'(160)]/50) is in a range of about 0.01 to about 0.05, S1/S2 is in a range of about 1.4 to about 5.0, and G'(160) is in a range of about $1.0\times10^2$ to about $3.0\times10^3$, wherein G'(80), G'(100), G'(110) and G'(160) respectively denote storage moduli (Pa) at temperatures of 80° C., 100° C., 110° C. and 160° C. at an angular speed of 6.28 rad/second, a temperature increase rate of 2.0° C./minute, and an initial deformation rate of 0.3%.

5. The toner of claim 1, wherein the toner comprises Fe of about $1.0\times10^3$ to about $1.0\times10^4$ ppm and Si of about $1.0\times10^3$ to about $5.0\times10^3$ ppm.

6. The toner of claim 1, wherein a ratio of [S]/[Fe] is in a range of about $5.0\times10^{-4}$ to about $5.0\times10^{-2}$, and wherein [Fe] is an intensity of an iron in the toner evaluated by fluorescent X-ray measurement and [S] is an intensity of a sulfur in the toner evaluated by fluorescent X-ray measurement.

7. The toner of claim 1, wherein an average particle size of the toner is in a range of about 3 to about 9 μm.

8. The toner of claim 1, wherein an average circularity of the toner is in a range of about 0.940 to about 0.990.

9. The toner of claim 1, wherein a GSDv value and a GSDp value of the toner are each about 1.30 or less.

* * * * *

UNITED STATES PATENT AND TRADEMARK OFFICE

CERTIFICATE OF CORRECTION

PATENT NO. : 8,741,517 B2
APPLICATION NO. : 13/233204
DATED : June 3, 2014
INVENTOR(S) : Pang et al.

It is certified that error appears in the above-identified patent and that said Letters Patent is hereby corrected as shown below:

In the Claims

Column 30, Line 25, In Claim 2, delete "0.5to" and insert -- 0.5 to --, therefor.

Signed and Sealed this
Twenty-third Day of September, 2014

Michelle K. Lee

Michelle K. Lee
*Deputy Director of the United States Patent and Trademark Office*